US006837691B2

(12) United States Patent
Tarutani et al.

(10) Patent No.: US 6,837,691 B2
(45) Date of Patent: Jan. 4, 2005

(54) REFRIGERATION SUCTION MECHANISM FOR A PISTON TYPE COMPRESSOR AND A PISTON TYPE COMPRESSOR

(75) Inventors: Tomoji Tarutani, Kariya (JP); Masaki Ota, Kariya (JP); Noriyuki Shintoku, Kariya (JP); Hisato Kawamura, Kariya (JP); Hirohiko Tanaka, Kariya (JP); Akio Saiki, Kariya (JP); Jun Kondo, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/300,441

(22) Filed: Nov. 20, 2002

(65) Prior Publication Data

US 2003/0095873 A1 May 22, 2003

(30) Foreign Application Priority Data

Nov. 21, 2001 (JP) ..... 2001-356475
Nov. 7, 2002 (JP) ..... 2002-324043

(51) Int. Cl.[7] ..... F04B 1/12
(52) U.S. Cl. ..... 417/269
(58) Field of Search ..... 417/222.1, 222.2, 417/269

(56) References Cited

U.S. PATENT DOCUMENTS 5,385,450 A * 1/1995 Kimura et al. ..... 417/269
5,626,463 A * 5/1997 Kimura et al. ..... 417/269
5,730,249 A * 3/1998 Shimizu ..... 417/269
6,030,184 A * 2/2000 Ikeda et al. ..... 417/269
6,231,314 B1 * 5/2001 Murakami et al. ..... 417/222.1

FOREIGN PATENT DOCUMENTS

JP 05-113174 5/1993
JP 06-147110 5/1994
JP 07-063165 3/1995
JP 09-091364 4/1997

OTHER PUBLICATIONS

Patent Abstracts of Japan corresponding to Japanese Laid-Open Publication No. 05-113174.
Patent Abstracts of Japan corresponding to Japanese Laid-Open Publication No. 07-063165.
Patent Abstracts of Japan corresponding to Japanese Laid-Open Publication No. 09-091364.
Patent Abstracts of Japan corresponding to Japanese Laid-Open Publication No. 06-147110 with an English translation of paragraphs [0013] and [0017].

* cited by examiner

*Primary Examiner*—Charles G. Freay
(74) *Attorney, Agent, or Firm*—Morgan & Finnegan, LLP

(57) ABSTRACT

A refrigeration suction mechanism used in a piston type compressor. The compressor comprises a rotary shaft, a plurality of pistons, a compression chamber and a rotary valve. The pistons are arranged in a circumference of the rotary shaft to reciprocate in conjunction with a rotating motion of the rotary shaft through a cam member. An end surface of one of said pistons reciprocates in the compression chamber. The rotary valve includes an introducing passage which allows refrigerant to flow into the compression mechanism through an end opened on an outer surface of the rotary valve. The refrigeration suction mechanism comprises a suction passage and a reactive force transmitting mechanism. The suction passage communicates with the cylinder bore and intermittently communicates with the end of the introducing passage in conjunction with a rotating motion of the rotary valve. The reactive force transmitting mechanism transmits a reactive force applied on one of the pistons that is in a discharging stroke so as to press the rotary valve against a mouth of the suction passage which communicates with a cylinder bore that contains the piston in the discharging stroke.

15 Claims, 10 Drawing Sheets

REFRIGERATION SUCTION MECHANISM FOR A PISTON TYPE COMPRESSOR AND A PISTON TYPE COMPRESSOR

BACKGROUND OF THE INVENTION

The present invention relates to a refrigeration suction mechanism for a piston type compressor. The refrigeration suction mechanism according to the present invention comprises a rotary valve which has a refrigerant introducing passage communicating with a passage extending through a rotary shaft to introduce refrigerant into a compression chamber within a cylinder bore.

A piston type compressor has a plurality of pistons each disposed in a cylinder bore in the circumference of a rotary shaft, so as to convert a rotation of the rotary shaft into reciprocating linear motion of the pistons through a cam.

Piston type compressors disclosed in Japanese Laid-Open Patent Publication 5-113174 and Japanese Laid-Open Patent Publication 7-63165 comprise a rotary valve for introducing refrigerant into the cylinder bores. A variable discharge swash plate type compressor disclosed in Japanese Laid-Open Patent Publication 5-113174 comprises a rotary valve which is separately formed from and connected to a rotary shaft. The rotary valve is rotatably contained in a valve chamber so as to allow rotational motion of the rotary shaft.

Japanese Laid-Open Patent Publication 7-63165 discloses a swash plate type compressor using double-headed pistons. The compressor has a suction passage radially extending in a journal portion of a rotary shaft and communicating with a refrigerant passage extending through the rotary shaft. The suction passage communicates with a suction port of one of cylinders that is in suction stroke as the suction passage rotates. In other words, the rotary shaft acts as a rotary valve. The suction port disclosed in the above publications is selectively opened by the rotary valve to introduce refrigerant into the cylinder bore. This improves volume efficiency compared to the compressor with a suction port selectively opened by a suction valve that can be distorted.

However in any of the compressors disclosed in the above publications, refrigerant contained in a cylinder bore which is in suction stroke is inclined to leak from the suction passage along the outer surface of the rotary valve. More specifically, while the compressor disclosed in Japanese Laid-Open Patent Publication 5-113174 preferred to have a least possible gap between the inner surface of the valve chamber and the outer surface of the rotary valve in order to minimize refrigerant leakage, manufacture of such is very difficult. The compressor disclosed in Japanese Laid-Open Patent Publication 7-63165 has a similar problem with respect to a gap between the through hole provided in a cylinder block and the outer surface of the rotary valve. Such leakage of the refrigerant lowered the volume efficiency of the compressor.

BRIEF SUMMARY OF THE INVENTION

It is an object of the present invention to improve volume efficiency in a piston type compressor using a rotary valve.

In order to achieve the above objectives, the present invention provides a refrigeration suction mechanism used in a piston type compressor, wherein a cam member mounted on a rotary shaft for the integral rotation with the rotary shaft converts a rotation of the rotary shaft to a linear reciprocating movement of pistons in cylinder bores arranged around the rotary shaft, wherein a compression chamber is defined in each of the cylinder bores by the associated piston, and wherein refrigerant is introduced to, compressed in and discharged from the compression chamber when the piston is in a suction stroke, a compressing stroke and a discharge stroke respectively, said compressor having a refrigerant passage for allowing the refrigerant to flow toward the compression chamber, said mechanism comprising:

a rotary valve integrally formed with the rotary shaft, said rotary valve including an introducing passage that is in communication with the refrigerant passage;

a suction passage having a first end and a second end , said first end being connected to each cylinder bore, and said second end being selectively connected to and disconnected from the introducing passage in accordance with the rotation of the rotary valve;

a means for transmitting a reaction force acting on the piston to the rotary valve, wherein said reaction force is generated in the compression chamber when the piston is in the discharge stroke, whereby the rotary valve is urged against the second end of the suction passage connected to the cylinder bore.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of the invention is described by referring to FIGS. 1 through 5. The first embodiment relates to a fixed-discharge compressor comprising a double headed piston.

Figure 1:
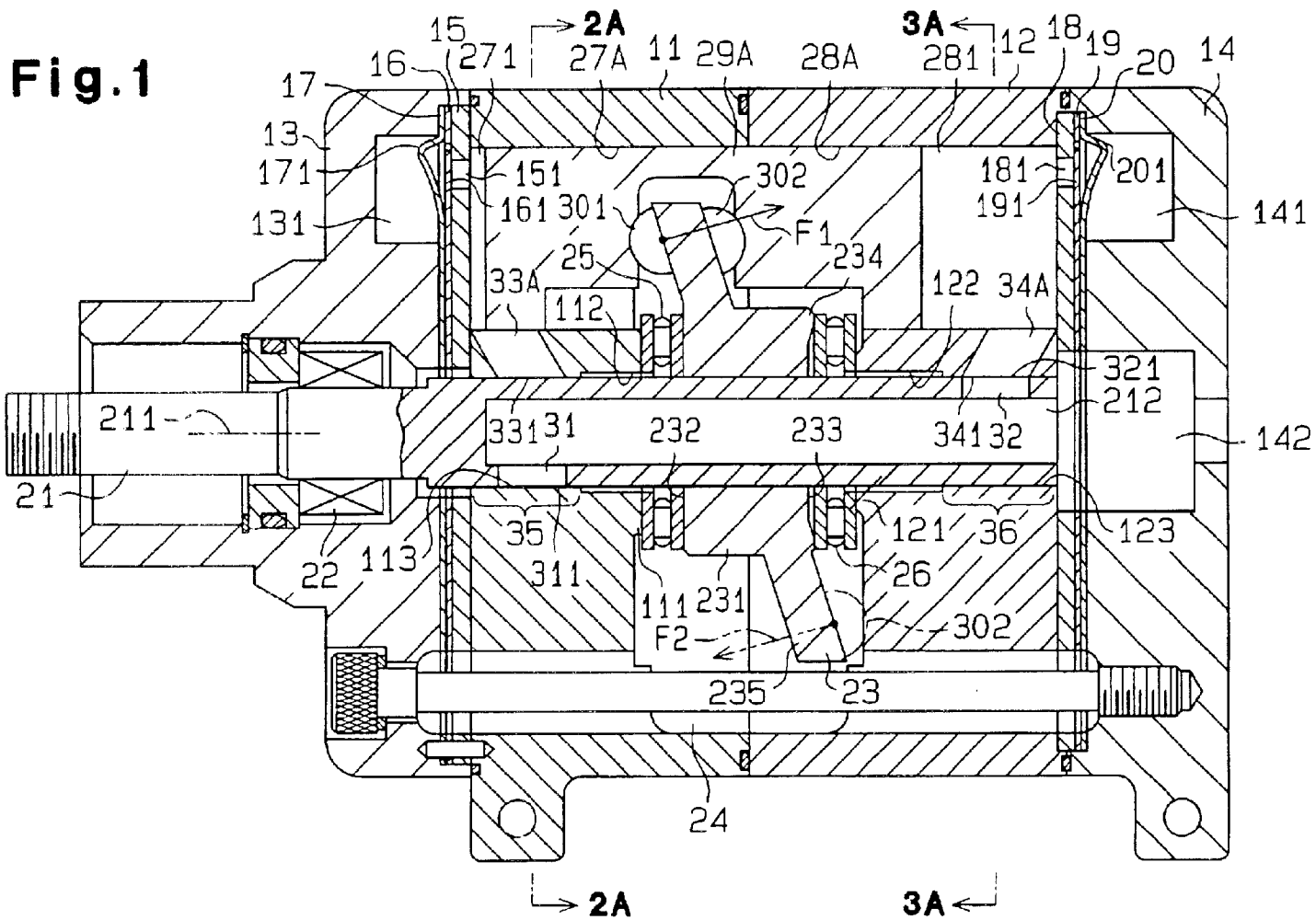
FIG. 1 is a cross sectional side view showing a compressor according to the first embodiment of the present invention.

As shown in FIG. 1, a front housing 13 and a rear housing 14 are respectively connected to cylinder blocks 11 and 12, which are connected to each other. A discharge chamber 131 is defined within a front housing 13. A discharge chamber 141 and a suction chamber 142 are defined in a rear housing 14.

In the front portion of the compressor, a valve plate 15, a valve forming plate 16 and a retainer forming plate 17 are interposed between the cylinder block 11 and the front housing 13. A valve plate 18, a valve forming plate 19 and a retainer forming plate 20 are interposed between the cylinder block 12 and the rear housing 14. Discharge ports 151 and 181 are respectively formed in the valve plates 15 and 18. Discharge valves 161 and 191 are respectively formed in the valve forming plates 16 and 19. The discharge valve 161 selectively opens the discharge port 151. A retainer 171 regulates an opening size of the discharge valve 161. Likewise, in the rear portion of the compressor, a valve plate assembly having a discharge port 181 and a discharge valve 191 is disposed between the cylinder block 12 and a rear housing 14. The discharge valve 191 selectively opens the discharge port 181. A retainer 201 regulates an opening size of the discharge valve 191.

A rotary shaft 21 is rotatably supported in cylinder blocks 11 and 12. The rotary shaft 21 is passed through holes 112 and 122 that are formed through cylinder blocks 11 and 12. The rotary shaft 21 is directly supported by the cylinder blocks 11 and 12 at the positions of the through holes 112 and 122.

A shaft seal 22 is interposed between front housing 13 and rotary shaft 21. A swash plate 23, which acts as a cam member comprising aluminum (including aluminum alloy), is mounted on the rotary shaft 21 in a swash plate chamber 24 that is defined between the cylinder blocks 11 and 12. The swash plate 23 has a plate-shaped portion 235 for slidably contacting shoes 301 and 302. An angle (swash plate tilt angle) between the plate-shaped portion 235 and a plane orthogonal to an axle 211 of the rotary shaft is fixed. A pair of thrust bearings 25, 26 are respectively interposed between edges of the cylinder blocks 11, 12 and both sides of a circular base portion 231 of the swash plate 23. The swash plate 23 is interposed between a pair of the thrust bearings 25 and 26 so that the swash plate 23 and the rotary shaft 21 which is fixed to the swash plate 23 are adjusted with respect to a relative movement in the direction of the axis 211 of the rotary shaft 21.

Figure 4:
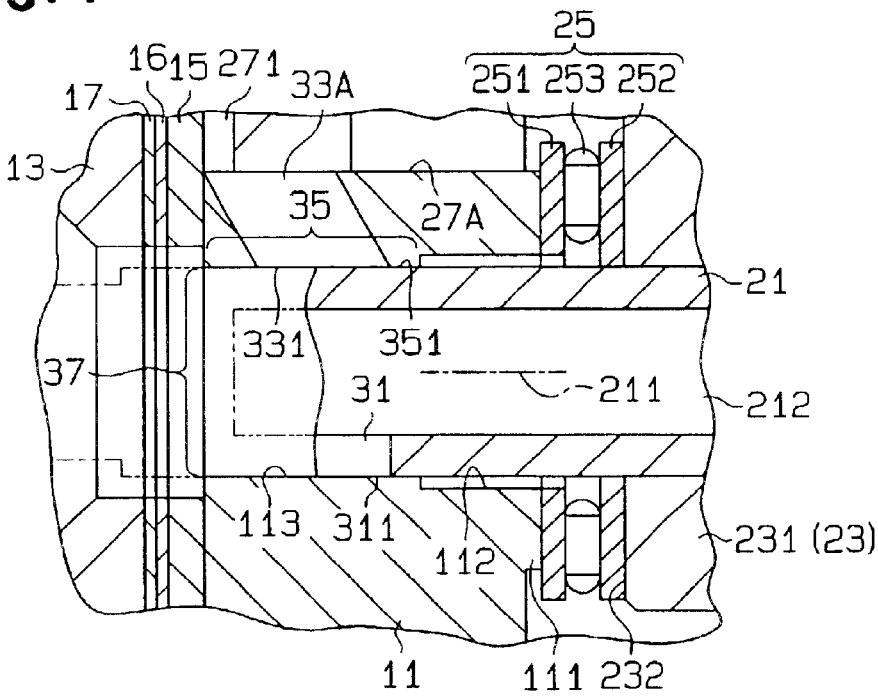
FIG. 4 is an enlarged cross sectional view showing a front end portion of the rotary shaft.

As shown in FIG. 4, the thrust bearing 25 includes a pair of races 251 and 252 and a plurality of rollers 253 disposed therebetween. A projection 111 is formed in an edge surface of the cylinder block 11. The race 251 abuts the projection 111. The race 252 of the thrust bearing 25 contacts an end surface 232 of a base portion 231 of the swash plate 23. When a thrust bearing 25 is observed from one end to the other end with respect to the rotary shaft 21, an area in which the projection 111 and the race 251 contact and an area in which the end surface 232 and the race 252 contact substantially overlap. Accordingly, the races 251 and 252 are not distorted by a thrust loading. Therefore, the thrust bearing 25 is not provided with a function to absorb the thrust loading.

Figure 5:
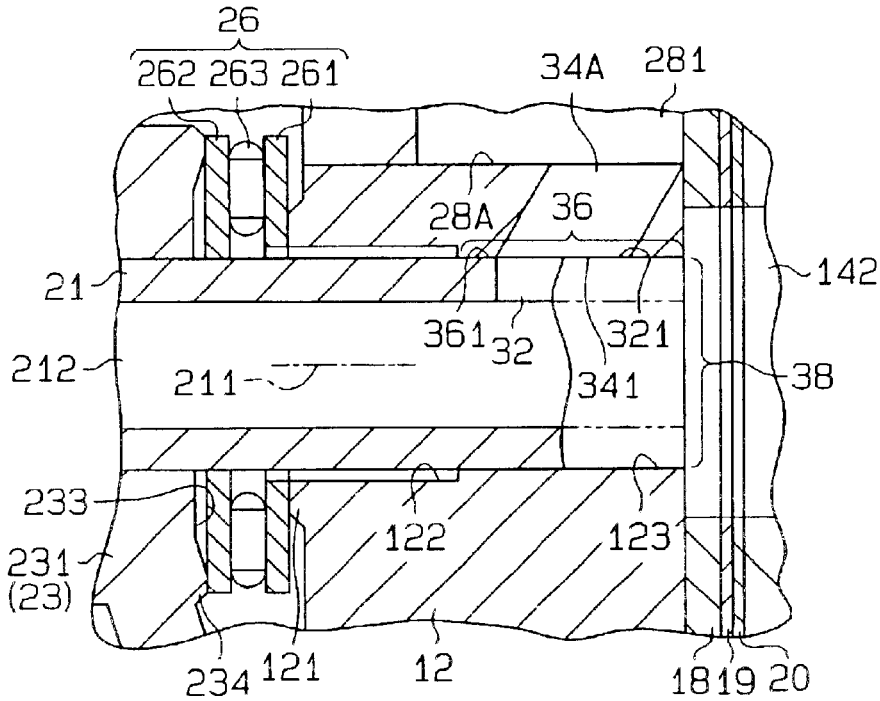
FIG. 5 is an enlarged cross sectional view showing a rear end portion of the rotary shaft.

A thrust bearing 26 includes a pair of races 261 and 262 and a plurality of rollers 263 disposed therebetween as shown in FIG. 5. A projection 121 is formed on an end surface of cylinder block 12. The race 261 abuts the projection 121. A projection 234 is formed in an edge surface 233 of the base portion 231 of a swash plate 23. The race 262 abuts the projection 234. The distance between the rotary shaft 21 and a point at which the projection 234 and the race 262 abuts is longer than the distance between the rotary shaft 21 and the point at which the projection 121 and the race 261 abuts. When the thrust bearing 26 is observed from one end to the other end with respect to the rotary shaft 21, an area in which the projection 121 and the race 261 contacts and an area at which the projection 234 and the race 262 contacts do not overlap. Accordingly, the races 261 and 262 are distorted by a thrust loading. Therefore, thrust bearing 26 is provided with a function to absorb thrust loading.

Figure 2A:
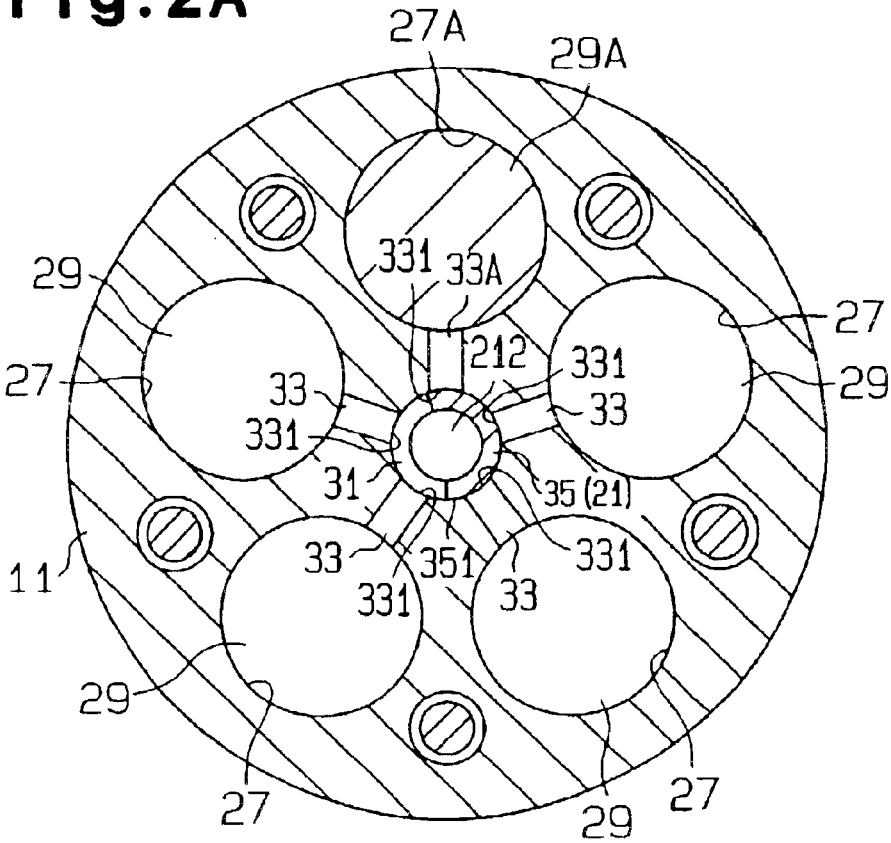
FIG. 2A is a cross sectional view taken along a line 2A—2A in FIG. 1.
Figure 3A:
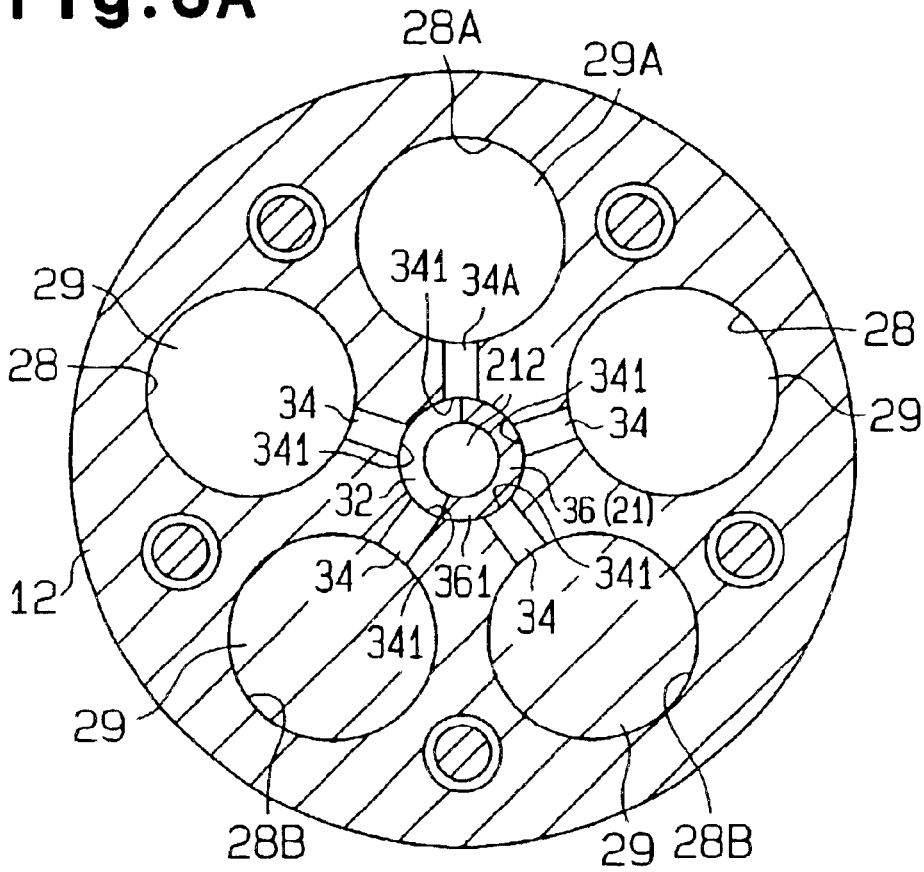
FIG. 3A is a cross sectional view taken along a line 3A—3Ain FIG. 1.

A plurality of cylinder bores 27 and 27A are formed in cylinder block 11 to be angularly spaced from one another in a circumference of the rotary shaft 21 as shown in FIG. 2A. Likewise, a plurality of cylinder bore 28, 28A and 28B are formed in cylinder block 12 to be angularly spaced from one another in a circumference of the rotary shaft 21 as shown in FIG. 3A. The cylinder bores 27 and 27A are opposed to the cylinder bores 28, 28B and 28A respectively to accommodate double-headed pistons 29 and 29A.

The rotation of the swash plate 23, which rotates integrally with the rotary shaft 21, is transmitted to each of the double-headed pistons 29 and 29A through shoes 301 and 302 so as to linearly reciprocate the double-headed piston 29 and 29A within the associated cylinder bore 27, 27A, 28, 28B and 28A. Compression chambers 271 and 281 are defined in the cylinder bores 27, 27A, 28, 28B and 28A.

Through holes 112 and 122 are formed respectively in the cylinder blocks 11 and 12 for allowing the rotary shaft 21 extending therethrough. Each of the through holes 112 and 122 extend with the different radii along the longitudinal direction of the rotary shaft 21. Sealing surfaces 113 and 123 are formed in contact with the rotary shaft 21 in a portion in which the through hole has the smallest radius. The rotary shaft 21 is directly supported by cylinder blocks 11 and 12 on the sealing surfaces 113 and 123.

A passage 212 is formed through the rotary shaft 21. An end of the passage 212 is in inside edge of the rotary shaft 21 and opens into the suction chamber 142 defined within the rear housing 14. Introducing passages 31 and 32 are respectively formed within the rotary shaft 21 in fluid communication with the passage 212.

Figure 2B:
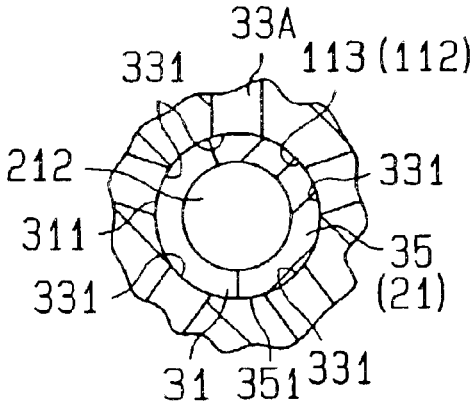
FIG. 2B is an enlarged cross sectional side view of a part of a refrigerant passage shown in FIG. 2A.
Figure 3B:
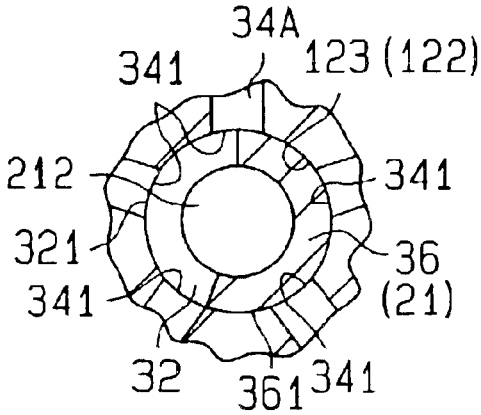
FIG. 3B is an enlarged cross sectional view of a part of a refrigerant passage shown in FIG. 3A.

Suction passages 33 and 33A are formed in the cylinder block 11 to allow cylinder bores 27 and 27A to be in communication with the through hole 112 as shown in FIGS. 2A, 2B and 4. A mouth 331 of suction passages 33 and 33A opens on a sealing surface 113. Suction passages 34 and 34A are formed in the cylinder block 12 to communicate cylinder bores 28, 28B and 28A with hole 122 as shown in FIGS. 3A, 3B and 5. A mouth 341 of suction passages 34 and 34A opens in a sealing surface 123. Ends 311 and 321 of the introducing passage 31 and 32 intermittently communicate with the mouths 331 and 231 of suction passages 33, 33A, 34 and 34A in conjunction with the rotation of the rotary shaft 21.

An end 311 of an introducing passage 31 and a mouth 331 of the suction passages 33 and 33A communicate while refrigerant is introduced into the cylinder bores 27 and 27A (namely the double-headed piston 29 and 29A moves from the left hand side of FIG. 1 toward the right). The refrigerant in the passage 212 of the rotary shaft 21 is introduced into the compression chamber 271 of the cylinder bores 27 and 27A, by way of the introducing passage 31 and the suction passages 33 and 33A.

The fluid communication between the end 311 and the mouth 331 of suction passages 33 and 33A are prohibited while the refrigerant in the cylinder bores 27 and 27A is compressed (namely the double-headed piston 29 and 29A move from the right hand side of FIG. 1 toward the left). The refrigerant compressed in the compression chamber 271 is discharged into the discharge chamber 131 from the discharge port 151 by pushing the discharge valve 161. The refrigerant discharged into the discharge chamber 131 is expelled into an external refrigerant circuit not shown in the figures.

An end 321 of an introducing passage 32 and a mouth 341 of the suction passage 34 and 34A are kept in communication with each other while refrigerant is introduced into the cylinder bores 28, 28B and 28A (namely the double-headed piston 29 and 29A moves from the right hand side of FIG. 1 toward the left). The refrigerant in the passage 212 of the rotary shaft 21 is thus introduced into the compression chamber 281 of the cylinder bores 28, 28B and 28A by way of the introducing passage 32 and the suction passages 34 and 34A.

The fluid communication between an end 321 and a mouth 341 of suction passage 34 and 34A is prohibited while the refrigerant in the cylinder bores 28, 28B and 28A is compressed (namely the double-headed piston 29 and 29A moves from the left hand side of FIG. 1 toward the right). The refrigerant compressed in the compression chamber 281 is discharged into the discharge chamber 141 from the discharge port 181 by pushing the discharge valve 191 while the cylinder bores 28, 28A and 28B are in discharging stroke. The refrigerant discharged into the discharge chamber 141 is expelled into an external refrigerant circuit. The refrigerant that is expelled to the external refrigerant circuit is circulated into the suction chamber 142.

Portions of the rotary shaft 21 which contact the sealing surfaces 113 and 123 act as the rotary valves 35 and 36 that are integrally formed with the rotary shaft 21 as shown in FIGS. 4 and 5. Instead of contacting the rotary shaft 21 with the sealing surfaces, these can be positioned to minimize the gap between them in order to prevent leakage of the refrigerant. The rotary valves 35 and 36 contact the sealing surfaces 113 and 123 in their outer surfaces 351 and 361. The sealing surface 113 is in an inner surface of valve accommodating portion 37 (shown in FIG. 4) which covers the rotary valve 35. The sealing surface 123 is in an inner surface of valve accommodating portion 38 (shown in FIG. 5) which covers rotary valve 36.

When the cylinder bore 27A shown in FIG. 1 is in discharging stroke, the lower cylinder bore 28B shown in FIG. 3 is also in discharging stroke. A double-headed piston 29A within the cylinder bore 27A that is in discharging stroke receives reactive force while compressing the refrigerant in the cylinder bore 27A and discharging the refrigerant to the discharge chamber 131. This reactive force is transmitted to the rotary shaft 21 by way of the double-headed piston 29A, the shoe 301 and the swash plate 23. The reactive force transmitted to the swash plate 23 through the double-headed piston 29A is applied to the swash plate 23 as a force shown by an arrow F1 in FIG. 1. The reactive force transmitted to the swash plate 23 through the double-headed piston 29 in the cylinder bore 28B also is applied to the swash plate 23 as a similar force F2 shown by an arrow F2 in FIG. 1. These forces F1 and F2 force the rotary shaft 21, which integrally supports the swash plate 23, to tilt centered at the center of the swash plate of 23. The rotary shaft 21 is supported by a bearing so as to be releasable from the inner surface of through holes 112 and 122. A displacement relative to the inner surface of the through holes 112 and 122 of the rotary shaft 21 is transmitted to the rotary valves 35 and 36. In other words, the reactive force against compression is transmitted to the rotary shaft 21 through the double-headed pistons 29A and 29 in the cylinder bores 27A and 28B in discharging stroke biases the rotary valve 35 in the direction of the cylinder bore 27A that is in discharging stroke. Similarly, the rotary valve 36 is also biased by the reactive force in the direction of cylinder bore 28B.

The shoes 301 and 302, the swash plate 23 and the rotary shaft 21 bias the rotary valves 35 and 36 by the reactive force toward the mouths 331 and 341 of the suction passage that communicate with the cylinder bores that are in discharging stroke.

An outer surface 351 of the rotary valve 35 is biased toward the cylinder bore 27A that is in discharging stroke. The outer surface 351 is urged toward the sealing surface 113 in proximity of the mouth 331 of the suction passage 33A. The suction passage 33A is in communication with the cylinder bore 27A which is in discharging stroke. An outer surface 361 of the rotary valve 36 that is biased toward the cylinder bore 28B of discharging stroke is pushed toward the sealing surface 123 in the proximity of the mouth 341 of the suction passage 34. The suction passage 34 is in communication with the cylinder bore 28B in discharging stroke. As a result, the refrigerant within compression chamber 271 and 281 of the cylinder bores 27A and 28B in discharging stroke is prevented from leaking from the suction passages 33A and 34. Accordingly, the volume efficiency in the compressor is improved.

While the thrust bearing 25 is not provided with a function to absorb a thrust loading, the bearing 26 is provided with a function to absorb a thrust loading. The function of the bearing 26 to absorb the thrust loading modifies election tolerance due to dimensional error of the parts. Accordingly, the bearing 26 permits the swash plate 23 to rotate in the direction of F1 and F2 shown in FIG. 1 centered at the center of the swash plate 23. In other words, the bearing 26 permits biasing the rotary valves 35 and 36 by reactive force in the direction of the mouth of the suction passage which communicates with the cylinder bore in discharging stroke. The configuration with the thrust bearing 26 acting to transmit the reactive force is a simple so that the refrigerant in the compression chambers 271 and 281 does not leak through the suction passage.

A portion of the rotary shaft 21 that extends away from the swash plate 23 toward the rotary valve 35 is supported only by the radial bearing including the sealing surface 113 (that is an inner surface of the valve accommodating portion 37) and an outer surface 351 of the rotary valve 35. The sealing surface 113 of the valve accommodating portion 37 acts as a radial bearing to support the rotary shaft 21 through the rotary valve 35. The sealing surface 113 biases the rotary valve 35 by transmitting a reactive force toward the mouth 331 of the suction passage 33A that communicate with the cylinder bore 27A in discharging stroke.

A portion of the rotary shaft 21 which extends away from the swash plate 23 toward the rotary valve 36 is supported only by the radial bearing including the sealing surface 123 (that is an inner surface of the valve accommodating portion 38) and an outer surface 351 of the rotary valve 35. The sealing surface 123 of the valve accommodating portion 38 acts as a radial bearing to support the rotary shaft 21 through the rotary valve 36. The sealing surface 123 biases the rotary valve 36 by transmitting the reactive force toward the mouth 341 of the suction passage 34 that communicate with the cylinder bore 28B in discharging stroke.

The configuration with the rotary shaft 21 supported by a radial bearing disposed in a portion of the outer surface of the rotary shaft 21 which extend away from the swash plate 23 toward the rotary valve improves an effect to block the mouth 331 and 341 of the suction passage 33A and 34A by a rotary valve 35 and 36.

The mouths 331 and 341 of the suction passages 33A and 34 respectively communicating with the cylinder bores 27A and 28B in discharging stroke are closed by the urging force applied to the rotary valves 35 and 36 and reactive force. This closed state is not effected by a size of the gap between the outer surface 351 and 361 of the rotary valve 35 and 36 and the sealing surface 113 and 123. Accordingly, because the strict control with respect to the tolerance of the gap is not required, the leakage of the refrigerant from the compression chamber 271 and 281 through the suction passages 33A and 34 is prevented even in the cases where the precision of the gap is low. Namely, the volume efficiency of the compressor is improved even when the gap is not precisely in tolerance.

The rotary shaft 21 is pressed against the sealing surface 113 of the cylinder block 11 in a position of rotary valve 35. The shaft 21 is pressed against sealing surface 123 of cylinder block 12 in the position of rotary valve 36. More concretely, the shaft 21 are pressed in an opposite directions. Therefore, it is necessary that the rotary shaft 21 be inclined to tilt with its center in the cross section, i.e. the center of the swash plate 23. The surface of the rotary shaft 21 and the inner surface of the holes 112 and 122 contact in a small area in the longitudinal direction. This makes the rotary shaft 21 easy to tilt. The configuration with the sealing surfaces 113 and 123 having a radius smaller than that of the holes. 112 and 122 makes the rotary shaft 21 easy to tilt.

The configuration with the rotary valve 35 and 36 fixingly supported on the rotary shaft 21 reduces the number of parts, resulting in the simple assembly process of the compressor.

A second embodiment will described hereinafter by referring to FIGS. 6A through 8.

Figure 6A:
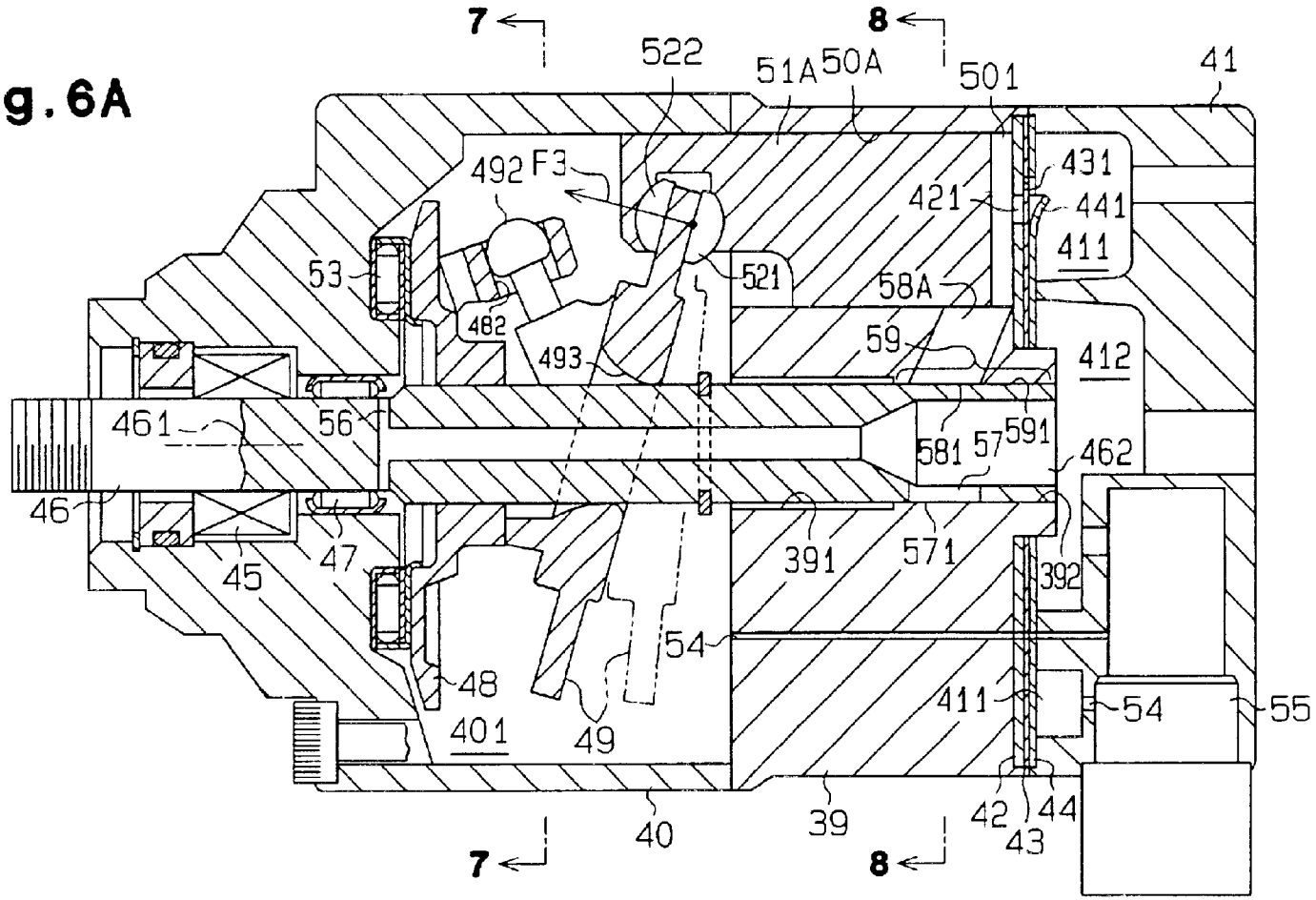
FIG. 6A is a cross sectional side view showing a compressor according to a second embodiment of the present invention.

A front housing 40 and a rear housing 41 are connected to a cylinder block 39 as shown in FIG. 6A. A valve plate assembly is disposed between the cylinder block 39 and the rear housing 41. A rotary shaft 46 is rotatably supported in the cylinder block 39 and the front housing 40 which defines a chamber 401 for which the pressure is controlled. The front housing 40 supports the rotary shaft 46 through a radial bearing 47. The rotary shaft 46 extends through a through hole 391 formed within the cylinder block 39, and the cylinder block 39 directly supports the rotary shaft 46.

A lag plate 48 is fixed to the rotary shaft 46. A pair of guide holes 481 and 482 (shown in FIG. 7) are formed in the lag plate 48. A swash plate 49, which acts as a cam member, is supported on the rotary shaft 46 to be slidable and tiltable in the longitudinal direction. A hole 493 is formed in the swash plate 49 to pass through the rotary shaft 46. A pair of guide pins 491 and 492 (shown in FIG. 7) are fixed to the swash plate 49. The swash plate 49 is tiltable in the axial direction (with respect to an axis 461) and is integrally rotatable with the rotary shaft 46 by the association of the guide holes 481 and 482 and the guide pins 491 and 492. While the swash plate 49 is illustrated by a solid line and a dotted line in FIG. 6A, the solid line shows the swash plate at its maximum tilt angle and the dotted line shows the swash plate at its minimum tilt angle.

Figure 8:
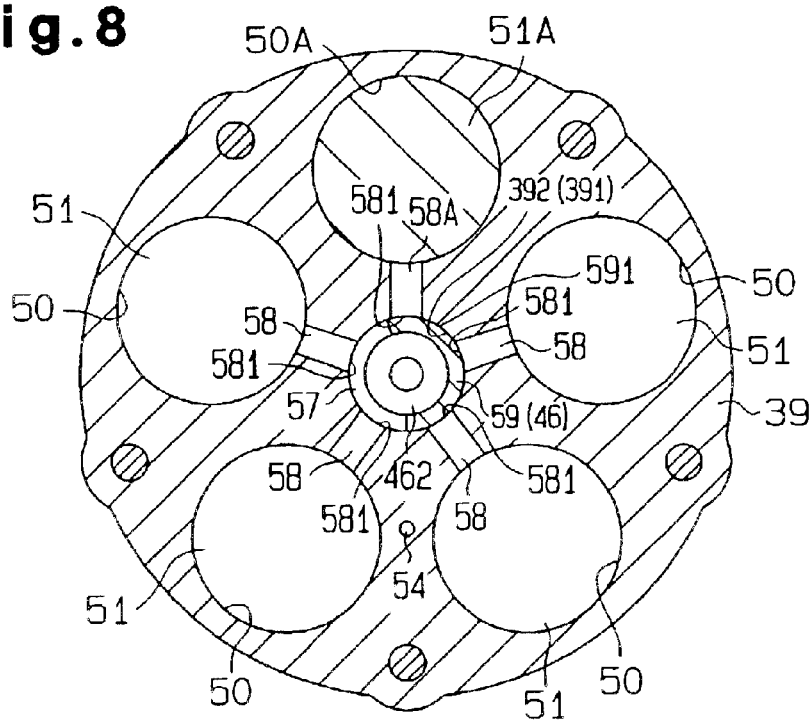
FIG. 8 shows a cross sectional view taken along a line 8—8in FIG. 6A.

A plurality of single-headed pistons 51 and 51A respectively are accommodated in a plurality of cylinder bores 50 and 50A formed in the cylinder block 39 as shown in FIGS. 6A and 8. A compression chamber 501 is defined within each of the cylinder bores 50 and 50A. Rotational motion of the swash plate 49 is transmitted to the single-headed pistons 51 and 51A through shoes 521 and 522 and converted into linear reciprocating motion of the single-headed pistons 51 and 51A within the cylinder bores 50 and 50A.

A discharge chamber 411 and a suction chamber 412 are formed within the rear housing 41 as shown in FIG. 6A. A discharge port 421 and a discharge valve 431 are included in the valve plate assembly. The discharge valve 431 selectively opens the discharge port 421. A retainer 441 is formed to regulate the opening size of the discharge valve 431.

A thrust bearing 53 is disposed in between the lag plate 48 and the front housing 40. A shaft seal 45 is interposed between the front housing 40 and the rotary shaft 46. A passage 462 is formed through the rotary shaft 46. An end of the passage 462 is in the inside edge of the rotary shaft 46 to open into the suction chamber 412 within the rear housing 41.

A discharge chamber 411 and a chamber 401 are in communication through a refrigerant passage 54. A displacement control valve 55 is disposed on the refrigerant passage 54. The displacement control valve 55 controls the amount of the refrigerant which flows out from the discharge chamber 411 into the chamber 401, pressure of which is controlled. The chamber 401 and the suction chamber 412 are in communication through the passage 462 and the refrigerant passage 56. The refrigerant in the chamber 401 flows out to the suction chamber 412 through the refrigerant passage 56. The tilt angle of the swash plate 49 is decreased as the pressure in the chamber 401 increase, and the tilt angle increases as the pressure in the chamber 401 is reduced. The displacement control valve 55 controls the tilt angle of the swash plate by adjusting the pressure within the chamber 401.

The radius of the through hole 391 allowing the rotary shaft 46 to extend therethrough varies in the longitudinal direction and a portion of the inner surface of the hole acts as a sealing surface 392. The radius at the sealing surface 392 is smaller than that at other portions of the inner surface of the through hole 391. The rotary shaft 46 is directly supported by the cylinder block 39 through the sealing surface 392.

A plurality of suction passages 58 and 58A are formed in the cylinder block 39 to allow the cylinder bores 50 and 50A to communicate with the through hole 391 as shown in FIG. 8. Mouths 581 of the suction passages 58 and 58A open in the sealing surface 392. An introducing passage 57 is formed in the rotary shaft 46 to be in communication with the passage 462. An end 571 of the introducing passage 57 intermittently communicate with the mouths 581 of the suction passages 58, and 58A in accordance with the rotation of the rotary shaft 46.

An end 571 and the mouths 581 of the suction passages 58 and 58A communicate while the refrigerant is introduced into the cylinder bores 50 and 50A (namely the single-headed pistons 51 and 51A move from the right hand side of FIG. 6A toward the left). The refrigerant in the passage 462 of the rotary shaft 46 is introduced into the compression chamber 501 of the cylinder bores 50 and 50A through the introducing passage 57 and the suction passages 58 and 58A while the cylinder bores 50 and 50A are in suction stroke.

The fluid communication of the end 571 and the mouths 581 of the suction passages 58 and 58A are prohibited while the refrigerant in the cylinder bores 50 and 50A is compressed (namely the single-headed pistons 51 and 51A move from the left hand side of FIG. 6A toward the right). The refrigerant is compressed in the compression chamber 501 in a compression stroke, and is discharged into a discharge chamber 411 from a discharge port 421 by pushing the discharge valve 431. The refrigerant discharged into the discharge chamber 411 is expelled out into an external refrigerant circuit not shown in the figures. The refrigerant expelled into the external refrigerant circuit is circulated into the suction chamber 412.

Figure 6B:
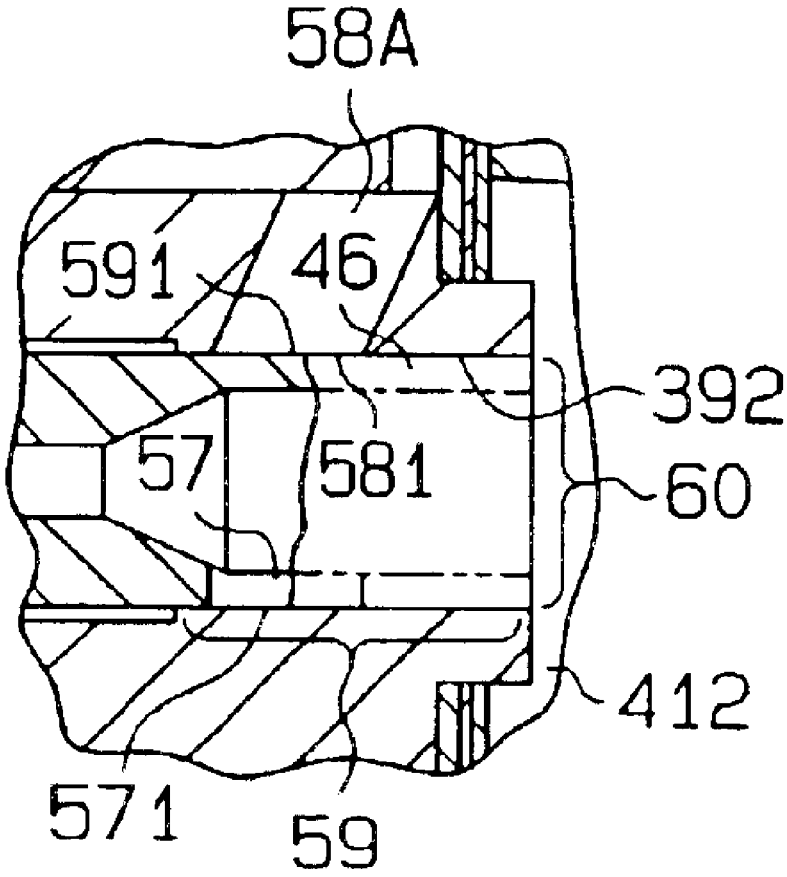
FIG. 6B is an enlarged cross sectional side view showing a rotary valve partially taken from FIG. 6B.
Figure 7:
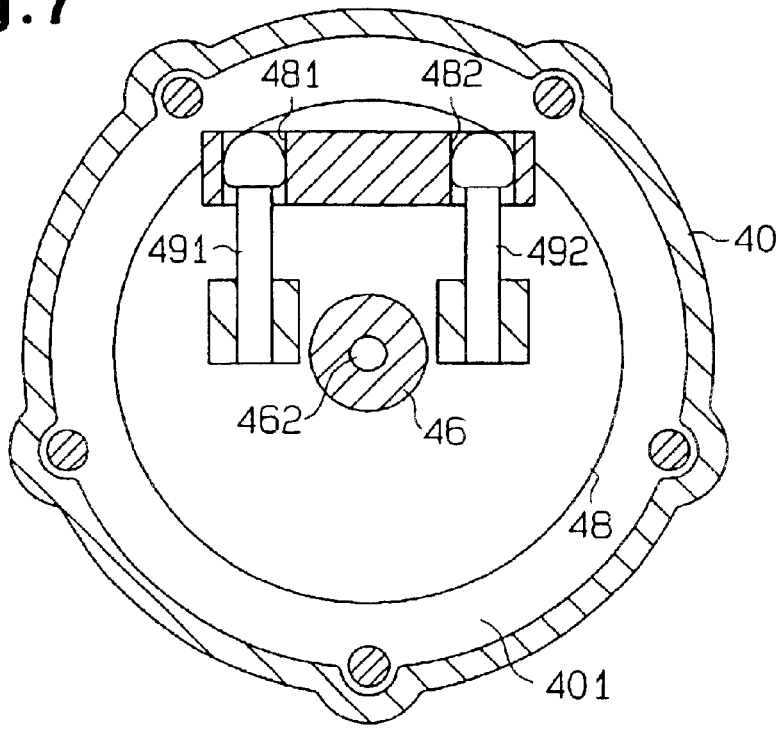
FIG. 7 is a cross sectional view taken along a line 7—7 in FIG. 6A.

A portion of the rotary shaft 46 which contacts the sealing surface 392 acts as a rotary valve 59 integrally formed with the rotary shaft 46 as shown in FIG. 6B. Instead of contacting the rotary shaft with the sealing surfaces, these can be positioned to minimize the gap between them in order to prevent leakage. A sealing surface 392, to which the outer surface 591 of the rotary valve 59 contacts, is an inner surface of the valve accommodating portion 60 in which the rotary valve 59 is contained.

A single-headed piston 51A within the cylinder bore 50A receives a reactive force from the refrigerant while compressing and discharging the refrigerant of the cylinder bore 50A into the discharge chamber 411, during discharging stroke of the cylinder bore 50A shown in FIG. 6A. A portion of the reactive force is transmitted to the front housing 40 by way of a single-headed piston 51A, a shoe 521, a swash plate 49, guide pins 491 and 492, a lag plate 48 and a thrust bearing 53. The reactive force transmitted to the swash plate 49 through a single-headed piston 51A is applied to the swash plate 49 as a force shown by an arrow F3 in FIG. 6A. The force F3 biases the swash plate 49 toward upper direction of FIG. 6A. The guide holes 481 and 482 are in the form of a hole directing substantially radial direction of the rotary shaft 46. Accordingly, the engagement of the guide pins 491 and 492 to the guide holes 481 and 482 will not disturb a motion of the swash plate 49 toward upper direction shown in FIG. 6A. The motion of the swash plate 49 toward the upper direction of FIG. 6A biases the rotary shaft 46 in the upper direction of FIG. 6A through engagement of the hole 493 and the surface of rotary shaft 46. The biasing force acts as a moment loading having a center in the position of engagement between the rotary shaft 46 and the radial bearing 47, so that the rotary valve 59 is biased in the direction of the cylinder bore 50A in discharging stroke. Namely, a reactive force transmitted to the rotary shaft 46 through a single-headed piston 51A in the cylinder bore 50A in discharging stroke biases the rotary valve 59 in the direction of the cylinder bore 50A.

A shoe 521, a swash plate 49, a hole 493 and a rotary shaft 46 bias the rotary valve 59 by the reactive force in the direction of the mouth 581 of the suction passage which is in communication with a cylinder bore that is in discharging stroke.

An outer surface 591 of the rotary valve 59 which is biased in the direction of a cylinder bore 50A in a discharging stroke is pushed against the sealing surface 392 so as to block the mouth 581 of the suction passage 58A. As a result, the refrigerant within the compression chamber 501 in the cylinder bore 50A in discharging stroke is prevented from leaking so as to improve the volume efficiency in the compressor.

A portion of the rotary shaft 46 which extends from the swash plate 49 toward the rotary valve 59 is supported only by a radial bearing including a sealing surface 392 (that is inner surface of a valve accommodating portion 60) and the outer surface 591 of the rotary valve 59. The sealing surface 392, which is the inner surface of the valve accommodating portion 60, acts as a part of radial bearing which supports the rotary shaft 46 through rotary valve 59. Further, the sealing surface 392 transmits the reactive force from the compressed refrigerant. The structure in which the rotary shaft 46 is supported solely by a radial bearing at a portion of the rotary shaft 46 which extends away from the swash plate 49 toward the rotary valve 59 improves the effect of blocking the mouth of the suction passage by a rotary valve.

A mouth 581 of the suction passage 58A which communicates with a cylinder bore 50A in discharging stroke is closed by pushing the rotary valve 59 by the reactive force. This closed state is not effected by the clearance size between the outer surface 591 of the rotary valve and the sealing surface 392. Accordingly, strict control is not necessary with respect to the tolerance of this clearance and the refrigerant which pass through from a compression chamber 501 within a cylinder bore 50A in discharging stroke to the suction passage 58A is prevented from leaking even in the cases where the manufacturing precision of the clearance is low. Namely, the volume efficiency in a compressor is improved in the cases where the manufacturing precision of the clearance is low.

In order that the rotary shaft 46 is pushed against a sealing surface 392 of the cylinder block 39 in a position of a rotary valve 59, the rotary shaft 46 is required to be easily tilted in the direction toward the cylinder bore 50A which is in discharging stroke. The rotary shaft 46 is more easily tilted as an area where an outer surface of the rotary shaft 46 and an inner surface of a hole 391 contact is smaller in the longitudinal direction of the rotary shaft 46. The structure which provides a sealing surface 392 having a smaller radius compared to other portions within the through hole 391 makes the rotary shaft 46 easier to tilt.

The structure in which a rotary valve 59 is integrally formed with a rotary shaft 46 reduces the number of parts and simplifies assembly process of the compressor.

Figure 9:
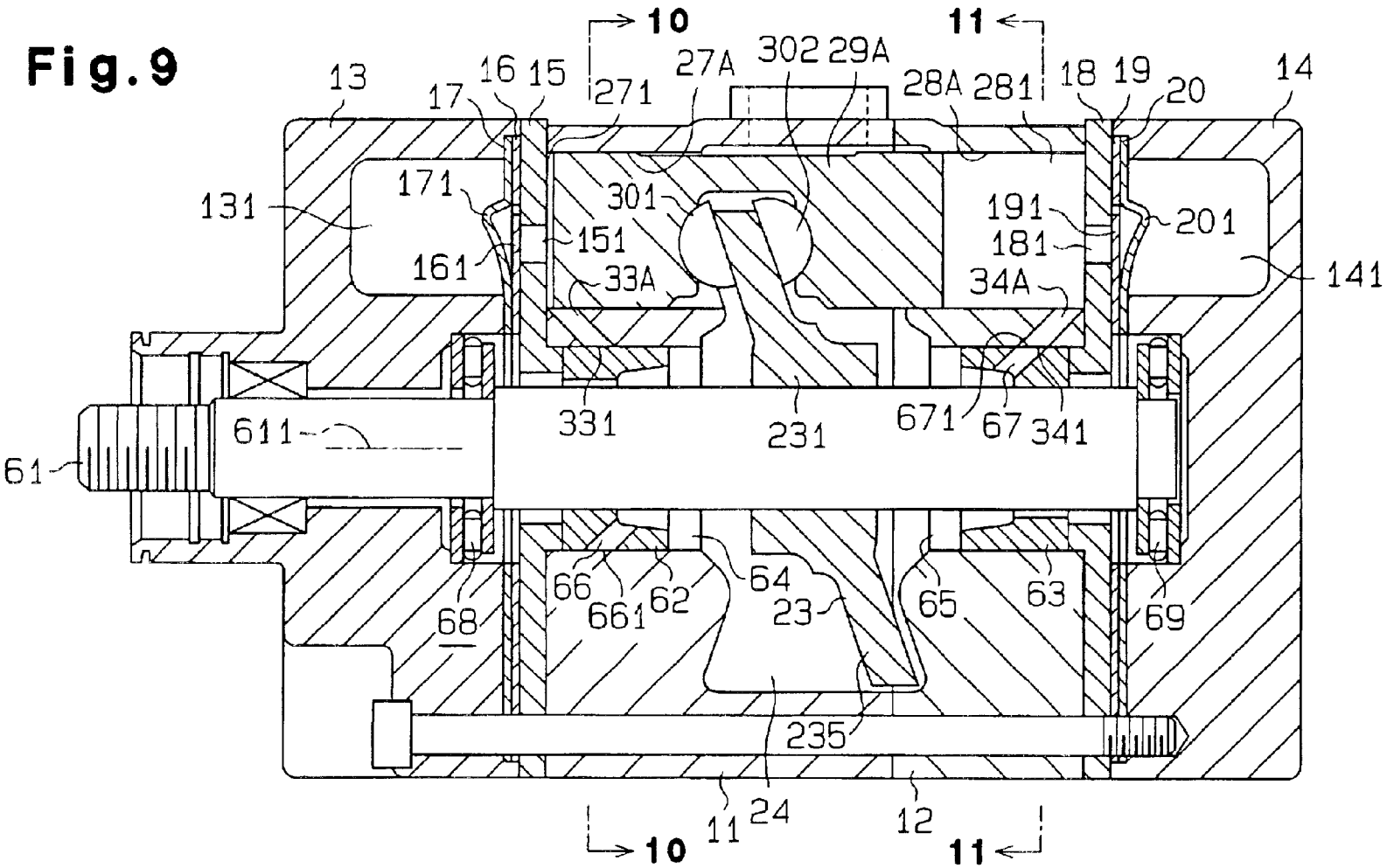
FIG. 9 is a cross sectional side view showing a compressor according to the third embodiment of the present invention.
Figure 10:
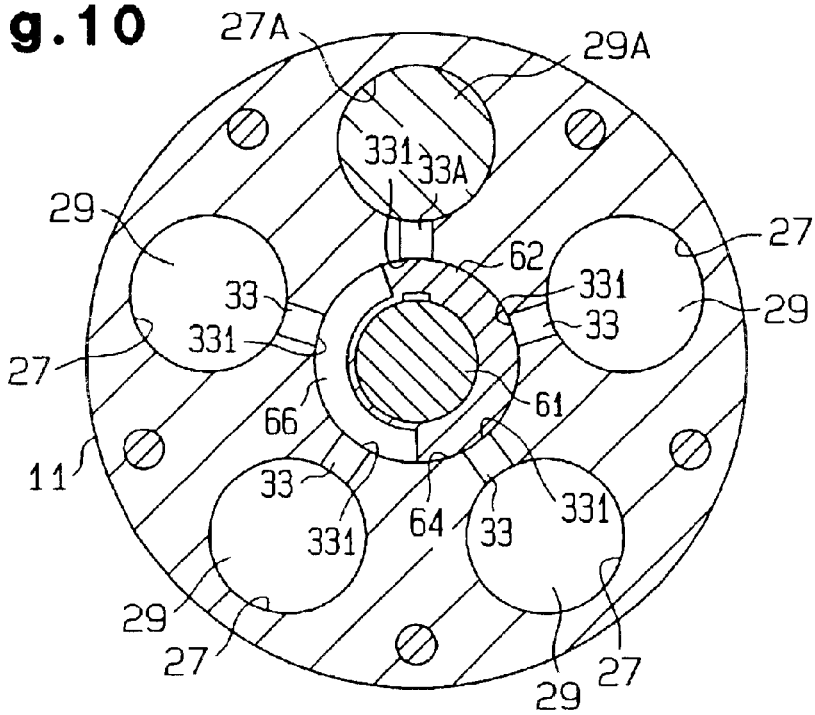
FIG. 10 is a cross sectional view taken along a line 10—10 in FIG. 9.
Figure 11:
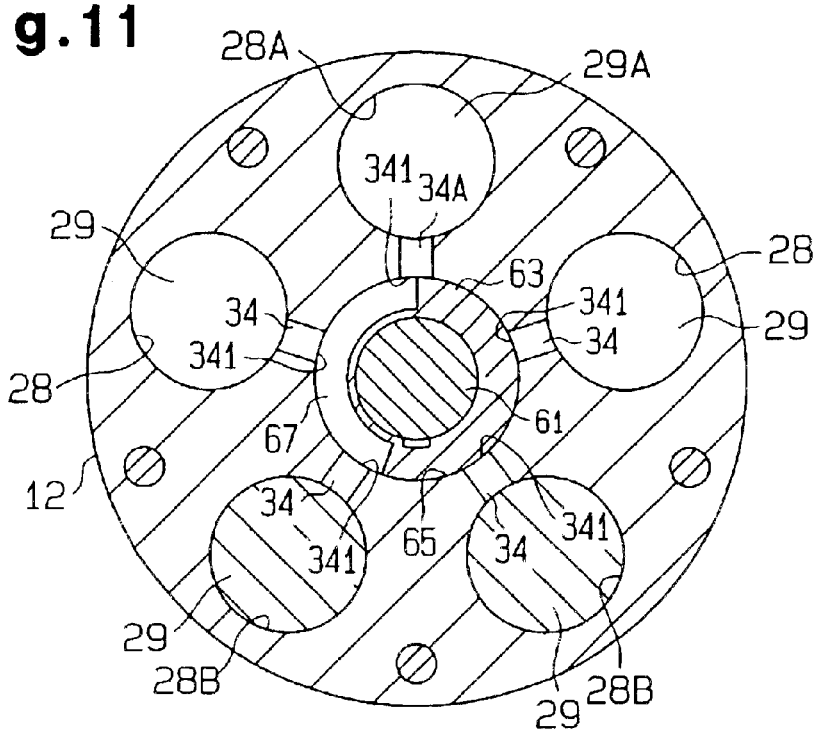
FIG. 11 is a cross sectional view taken along a line 11—11 in FIG. 9.

The third embodiment shown in FIGS. 9 through 11 are next described. Elements similar to those described in the first embodiment are numbered with like reference numerals.

Rotary valves 62 and 63 are fixed to a rotary shaft 61 and are contained within valve accommodating portions 64 and 65. Introducing passages 66 and 67 formed in rotary valves 62 and 63 are in communication with a swash plate chamber 24. The swash plate chamber 24 is a suction chamber which communicates with an external refrigerant circuit (not shown in the figures). Ends 661 and 671 of the introducing passages 66 and 67 and mouths 331 and 341 of suction passages 33, 33A, 34 and 34A intermittently communicate along with rotation of rotary valves 62 and 63. Refrigerant within the swash plate chamber 24 is introduced into the compression chambers 271 and 281 of the cylinder bores 27 and 28 that are in suction stroke, by way of the introducing passages 66 and 67 and suction passages 33, 33A, 34 and 34A.

The displacement of a rotary shaft 61 in the direction of the axis 611 is regulated by a pair of thrust bearings 68 and 69. Both of the thrust bearings 68 and 69 are provided with a function to absorb thrust loading. The thrust bearings 68 and 69 act to transmit a reactive force against compression similarly as a thrust bearing 26 described with respect to the first embodiment. While the number of parts is increased in the third embodiment since the rotary valves 62 and 63 are provided separately from the rotary shaft 61, other advantages as described with respect to the first embodiment can be obtained similarly.

It should be apparent to those skilled in the art that the present invention may be embodied in many other specific forms without departing from the spirit or scope of the invention. Particularly, it should be understood that the invention may be embodied in the following forms.

The thrust bearing 25 of the first embodiment may be provided with a function to absorb thrust loading. By providing such function, the rotary valves 35 and 36 are more easily allowed to be pushed toward the mouth of the suction passage which communicate cylinder bores that are in discharging stroke, by the compression reactive force. As a result, the refrigerant in the compression chambers in the cylinder bores that are in discharging stroke are prevented from leaking, and the volume efficiency of the compressor is improved.

In the case where the rotary valve is integrally formed with rotary shaft, the rotary shaft may be manufactured to have a maximum radius in the proximity at a position where the rotary valve is formed. In this way, a portion of the rotary shaft which extends from the swash plate toward the rotary valve is supported only by a radial bearing including a sealing surface (that is inner surface of valve accommodating portion) and an outer surface of the rotary valve so as to improve effect to block the mouth of the suction passage by the rotary valve.

Figure 12A:
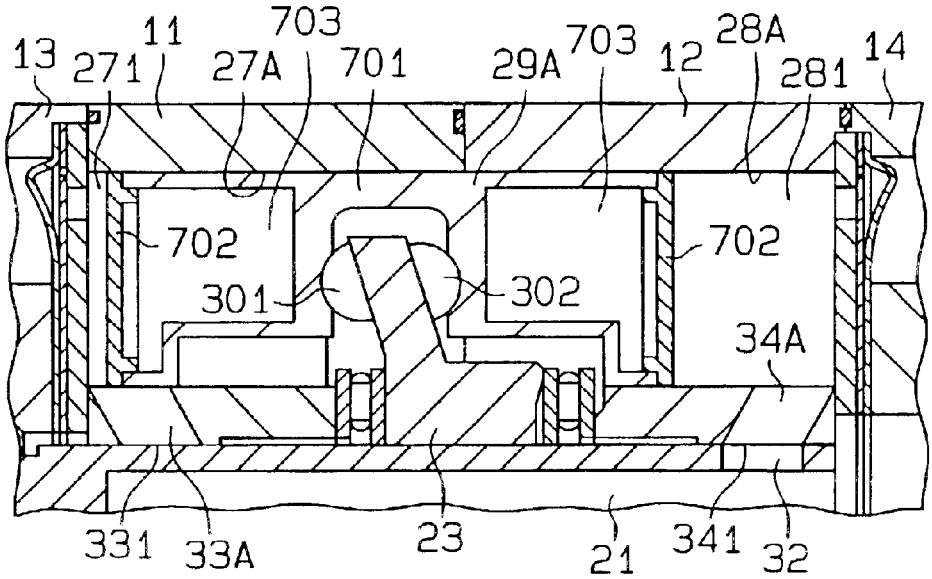
FIG. 12A is a cross sectional view showing a double-headed piston according to another embodiment.
Figure 12B:
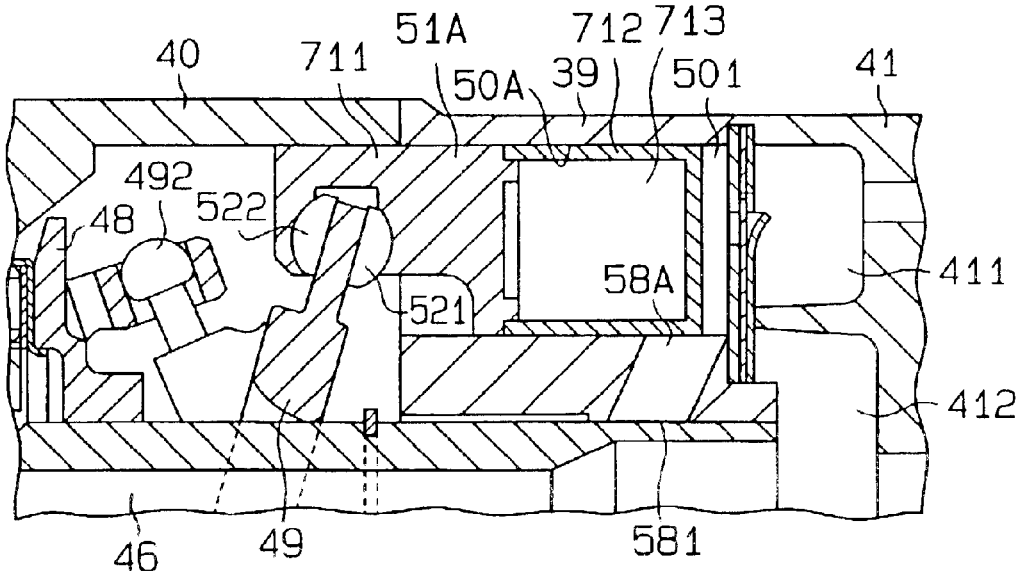
FIG. 12B is a cross sectional view showing a single-headed piston according to another embodiment.

The pistons may have a hollow structure. Examples of such are shown in FIGS. 12A and 12B. Namely, a double-headed piston 29A of FIG. 12A comprises a body portion 701 that is connected to shoes 301 and 302, and cap portions 702 that are fixed at reciprocating ends of the body portion 701. The double-headed piston 29A has a hollow structure with a space 703, which is enclosed by the body portion 701 and the cap portion 702. Other double-headed pistons 29 have similar structures.

A single-headed piston 51A of FIG. 12B comprises a coupling portion 711 to be coupled with shoes 521 and 522, and a head portion 712 that is fixed at a rear end of the coupling portion 711. The single-headed piston 51A has a hollow structure with a space 713, which is enclosed by the coupling portion 711 and the head portion 712. In this case, other single-head pistons 51 have similar structures.

A piston receives an inertial force which is directed to a direction opposite to the compression reactive force. Accordingly, the forces F1, F2 and F3, which work on the swash plate 23 due to the compression reactive force, are smaller as the inertial force increases. The biasing force, which pushes the outer surface of the rotary valve toward the sealing surface in the neighborhood of the suction passage when the piston receives the compression reactive force from the refrigerant, is weakened.

Accordingly, the inertial force is lowered in the case where the weight of the pistons is reduced by adopting a hollow structure, compared to a case where the pistons are solid. In this way, decrease in the volume efficiency due to leakage of refrigerant within the compression chambers that are in discharging stroke through the suction passages, is suppressed.

The swash plate 23 can be made of a material such as iron (including iron alloy) having a larger specific gravity than aluminum, in the first and the third embodiments. In this way, the centrifugal force, which acts on the swash plate 23 during rotation of the rotary shaft 12, can be increased without manufacturing larger swash plate, compared to the case where the swash plate 23 is made of aluminum.

The rotary shaft 21 receives a force which acts to rotate the fixed rotary shaft 21 and the swash plate 23 in a direction in which an angle between the longitudinal direction of the plate-shaped portion 235 and the central axis of the housing increases toward 90 degrees. This direction is clockwise in FIGS. 1 and 9. In other words, such force acts upon the rotary valve 35 and 36 to be forced toward the mouth 331 and 341 of the suction passage in communication with the cylinder bore which is in discharging stroke.

Since the swash plate 23 of the first and the third embodiments comprises aluminum, the swash plate has a relatively light weight. The above described effect of the centrifugal force to push the rotary valve 35 and 36 toward mouth 331 and 341 of suction passage is not fully exhibited in these embodiments. On the other hand, the force to push the rotary valve 35 and 36 toward mouth 331 and 341 of suction passage communicating the cylinder bore in the discharging stroke is increased when the swash plate 23 is formed from a material which has a relatively large specific gravity such as materials comprising iron. The refrigerant in the compression chambers that are in discharging stroke is prevented from leaking through suction chamber in this way, so that the volume efficiency of the compressor is increased.

While the rotary valve of the first and second embodiments are described to be pushed against the inner surface of the valve accommodating portion, the rotary valves can be formed to decrease clearance in between to prevent leakage, instead of contacting the inner surface of the valve accommodating portion.

It is also possible to apply present invention to a wobble type variable displacement compressor disclosed in Japanese Laid-Open Patent Publication 5-113174, constant displacement piston type compressor having a single-headed piston and a piston type compressor having a cam member having a shape other than swash plate, a wave cam for example.

Therefore, the present examples and embodiments are to be considered as illustrative and not restrictive and the invention is not to be limited to the details given herein, but may be modified within the scope and equivalence of the appended claims.

What is claimed is:

1. A refrigeration suction mechanism used in a piston type compressor, wherein a cam member mounted on a rotary shaft for the integral rotation with the rotary shaft converts a rotation of the rotary shaft to a linear reciprocating movement of pistons in cylinder bores arranged around the rotary shaft, wherein a compression chamber is defined in each of the cylinder bores by the associated piston, and wherein refrigerant is introduced to, compressed, in and discharged from the compression chamber when the piston is in a suction stroke, a compressing stroke and a discharge stroke respectively, said compressor having a refrigerant passage for allowing the refrigerant to flow toward the compression chamber, said mechanism comprising:

a rotary valve formed integrally with the rotary shaft, or fixed to the rotary shaft to be integral with the rotary shaft, said rotary valve including an introducing passage that is in communication with the refrigerant passage;

suction passages, each corresponding to one of the cylinder bores and having a first end and a second end, said first end being connected to the corresponding cylinder bore, and said second end being selectively connected to and disconnected from the introducing passage in accordance with the rotation of the rotary valve;

a means for transmitting a reaction force acting on the piston to the rotary valve, wherein said reaction force is generated in the compression chamber when the piston is in the discharge stroke, whereby the rotary valve is urged against the second end of the suction passage connected to the cylinder bore that is in the discharge stroke.

2. A refrigeration suction mechanism according to claim 1, wherein said rotary valve is integrally formed with said rotary shaft.

3. A refrigeration suction mechanism according to claim 1, further comprising a valve accommodating portion to surround the rotary valve, said accommodating portion having an inner wall, and said rotary valve having an outer surface, wherein the second end of the suction passage is opened in the inner wall of the accommodating portion, and wherein said inner wall and said outer surface serve as a sole radial bearing which supports the rotary shaft in an area that extends away from the cam member toward the rotary valve.

4. A refrigeration suction mechanism according to claim 2, wherein a through hole accommodates the rotary shaft, wherein the through hole has a small diameter portion including an inner surface that functions as a sealing surface, wherein said sealing surface supports the rotary shaft.

5. A refrigeration suction mechanism according to claim 2 or 3, wherein each of the pistons is a double-headed piston accommodated in a pair of cylinder bores opposed to one another with respect to the piston, each of said cylinder bores being associated with a rotary valve, wherein the rotary valves rotate integrally with the rotary shaft, wherein a pair of thrust bearings are opposed to each other with respect to the cam member to regulate a displacement of the cam member along the rotary shaft and wherein said transmitting means includes at least one of the thrust bearings capable of absorbing thrust loading.

6. A refrigeration suction mechanism according to claim 2, wherein the compressor is a variable displacement compressor, wherein said cam member includes a tiltable swash plate, wherein each of said pistons is a single-headed piston, wherein the swash plate has a hole for allowing the rotary shaft to pass therethrough, wherein said hole has an inner peripheral surface engaging the rotary shaft and receiving the reaction force from the swash plate and transmits the force to the rotary valve by way of the rotary shaft.

7. A piston type compressor, wherein a discal cam member is mounted on a rotary shaft which extends in a housing through a center of the cam member for the integral rotation with the cam member, said cam member converts a rotation of the rotary shaft to a linear reciprocating movement of pistons in cylinder bores arranged around the rotary shaft, wherein a compression chamber is defined in each of the cylinder bores by the associated piston, wherein refrigerant is introduced to, compressed in and discharged from the compression chamber when the piston is in a suction stroke, a compressing stroke and a discharge stroke respectively, and wherein said piston receives a reactive force against the compression of the refrigerant when the piston is in the discharge stroke, said compressor comprising:

a rotary valve integrally formed with the rotary shaft, said rotary valve including an introducing passage that is in communication with the compression chamber;

suction passages, each corresponding to one of the cylinder bores and having a first end and a second end, said first end being connected to the corresponding cylinder bore, and said second end being selectively connected to and disconnected from the introducing passage in accordance with the rotation of the rotary valve;

a valve accommodating portion provided in the housing to surround the rotary valve, said accommodating portion having an inner wall, and said rotary valve having an outer surface, wherein the second end of each suction passage is opened in the inner wall of the accommodating portion, and wherein said inner wall and said outer surface serve as a sole radial bearing which supports the rotary shaft in an area that extends away from the cam member toward the rotary valve; and a thrust bearing which holds the cam member on the rotary shaft extending through the center of the cam member, wherein said bearing allows the cam member on the rotary shaft to tilt by the reactive force transmitted from the piston, whereby the outer surface of the rotary valve is urged against the second end of the suction passage connected to the cylinder bore that is the discharge stroke.

8. A compressor according to claim 7, wherein the inner wall of the accommodating portion has a small diameter portion including an inner surface that functions as a sealing surface, wherein said sealing surface supports the rotary shaft.

9. A compressor according to claim 7, wherein each of the pistons is a double-headed piston accommodated in a pair of cylinder bores opposed to one another with respect to the piston, each of said cylinder bores being associated with a rotary valve, wherein the rotary valves rotate integrally with the rotary shaft, wherein the cam member rotates integrally with the rotary shaft, wherein said thrust bearing is one of a pair of thrust bearings, which are opposed to each other with respect to the cam member to regulate a displacement of the cam member along the rotary shaft, and wherein at least one of the thrust bearings is capable of absorbing thrust loading.

10. A compressor according to claim 7, wherein the compressor is a variable displacement compressor, wherein said cam member includes a tiltable swash plate, wherein each of said pistons is a single-headed piston, wherein the swash plate has a hole for allowing the rotary shaft to pass therethrough, wherein said hole has an inner peripheral surface, the inner peripheral surface engaging the rotary shaft to transmit the reaction force from the swash plate to the rotary valve by way of the rotary shaft.

11. A piston type compressor, wherein a cam member mounted on a rotary shaft for the integral rotation with the rotary shaft converts a rotation of the rotary shaft to a linear reciprocating movement of pistons in cylinder bores arranged around the rotary shaft, wherein a compression chamber is defined in each of the cylinder bores by the associated piston, and wherein refrigerant is introduced to, compressed in and discharged from the compression chamber when the piston is in a suction stroke, a compressing stroke and a discharge stroke respectively, said rotary shaft having a refrigerant passage extending therethrough, said compressor comprising:

a rotary valve formed integrally with the rotary shaft, or fixed to the rotary shaft to be integral with the rotary shaft, said rotary valve including an introducing passage that is in communication with the refrigerant passage;

suction passages, each corresponding to one of the cylinder bores and having a first end and a second end, said first end being connected to the corresponding cylinder bore, and said second end being selectively connected to and disconnected from the introducing passage in accordance with the rotation of the rotary valve;

a valve accommodating portion provided in the housing to surround the rotary valve, said accommodating portion having an inner wall, and said rotary valve having an outer surface, wherein the second end of each suction passage is opened in the inner wall of the accommodating portion, and wherein said inner wall and said outer surface serve as a sole radial bearing which supports the rotary shaft in an area that extends away from the cam member toward the rotary valve; and a means for transmitting a reaction force acting on the piston to the rotary valve, wherein said reaction force is generated in the compression chamber when the piston is in the discharge stroke, whereby the outer surface of the rotary valve is urged against the second end of the suction passage connected to the cylinder bore that is in the discharge stroke.

12. A compressor according to claim 11, wherein said rotary valve is integrally formed with said rotary shaft.

13. A compressor according to claim 11, wherein the inner wall of the accommodating portion has a small diameter portion including an inner surface that functions as a sealing surface, wherein said sealing surface supports the rotary shaft.

14. A compressor according to claim 11, wherein each of the pistons is a double-headed piston accommodated in a pair of cylinder bores opposed to one another with respect to the piston, each of said cylinder bores being associated with a rotary valve, wherein the rotary valves rotate integrally with the rotary shaft, wherein the cam member rotates integrally with the rotary shaft, wherein a pair of thrust bearings are opposed to each other with respect to the cam member to regulate a displacement of the cam member along the rotary shaft and wherein said transmitting means includes at least one of the thrust bearings capable of absorbing thrust loading.

15. A compressor according to claim 11, wherein the compressor is a variable displacement compressor, wherein said cam member includes a tiltable swash plate, wherein each of said pistons is a single-headed piston, wherein the swash plate has a hole for allowing the rotary shaft to pass therethrough, wherein said hole has an inner peripheral surface, the inner peripheral surface engaging the rotary shaft to transmit the reaction force from the swash plate to the rotary valve by way of the rotary shaft.

* * * * *